US007969707B2

(12) United States Patent
Riskin

(10) Patent No.: US 7,969,707 B2
(45) Date of Patent: Jun. 28, 2011

(54) METHOD OF BIPOLAR ION GENERATION AND AERODYNAMIC ION GENERATOR

(76) Inventor: Yafim Riskin, Katzrin (IL)

( * ) Notice: Subject to any disclaimer, the term of this patent is extended or adjusted under 35 U.S.C. 154(b) by 0 days.

(21) Appl. No.: 12/687,498

(22) Filed: Jan. 14, 2010

(65) Prior Publication Data

US 2011/0116204 A1 May 19, 2011

(30) Foreign Application Priority Data

Nov. 19, 2009 (IL) ..... 202219

(51) Int. Cl.
*H01T 23/00* (2006.01)

(52) U.S. Cl. ..... 361/230; 361/231; 361/232; 361/233; 361/234; 361/235

(58) Field of Classification Search ..... None
See application file for complete search history.

(56) References Cited

U.S. PATENT DOCUMENTS

| | | | | |
|---|---|---|---|---|
| 4,517,462 | A * | 5/1985 | Boyer et al. | 250/286 |
| 4,734,580 | A * | 3/1988 | Rodrigo et al. | 250/324 |
| 5,048,824 | A * | 9/1991 | Chen | 482/2 |
| 5,768,087 | A * | 6/1998 | Vernitskiy | 361/230 |
| 6,137,670 | A * | 10/2000 | West et al. | 361/213 |
| 2009/0042502 | A1 * | 2/2009 | Kim et al. | 454/139 |
| 2010/0188793 | A1 * | 7/2010 | Uchida et al. | 361/231 |

FOREIGN PATENT DOCUMENTS

| | | | |
|---|---|---|---|
| JP | 2004 03 1297 | A | 1/2004 |
| JP | 2004 362 855 | A | 12/2004 |
| WO | WO 2004 008597 | A1 | 1/2004 |

* cited by examiner

*Primary Examiner* — Jared J Fureman
*Assistant Examiner* — Terrence R Willoughby
(74) *Attorney, Agent, or Firm* — Pearl Cohen Zedek Latzer, LLP

(57) ABSTRACT

An aerodynamic ion generator is disclosed. The generator includes an electric motor coupled to a propeller for placing in an airflow to generate electrical energy, with ionizing electrodes coupled to the propeller; a generator powered by the electric motor for generating AC high-voltage; an electrical transmission arrangement for transmitting the AC high voltage to the ionizing electrodes of different polarities; and a cleaning device that includes arms, each of the arms for cleaning a corresponding ionizing electrode of the ionizing electrodes and pivotally attached to a shaft located on the propeller wherein most of the mass of the arm is closer to a cleaning end of the arm than to the shaft that arm is attached to.

12 Claims, 3 Drawing Sheets

METHOD OF BIPOLAR ION GENERATION AND AERODYNAMIC ION GENERATOR

CROSS-REFERENCE TO RELATED APPLICATIONS

This application claims priority from Israeli Patent Application Number 202219, filed on Nov. 19, 2009, which is incorporated in its entirety herein by reference.

FIELD OF THE INVENTION

Method of bipolar ion generation and aerodynamic ion generator relate to ion generators based on ventilator wherein the air ionizing electrodes that rotate together with the propeller are designated to be the major elements of the ventilation and air conditioning system in places where it might be difficult or even impossible to perform preventive cleaning of the ionizing electrodes from dust and where traditional power sources such as network are not available.

BACKGROUND OF THE INVENTION

Unipolar generator is known in which electric motor is used as a power source powering the high voltage source. This motor is coupled to a propeller for placing in air flow of the ventilation and air conditioning systems (refer to JP2004 03 1297A).

The main drawback of this invention consists in that it does not perform an operation and does not include elements designated for cleaning of air ionizing electrodes from dust.

Indeed, such ion generator mounted at the air-duct outlet on the premises ceiling presents difficulties for periodic cleaning of electrodes from dust, particularly in high ceiling premises.

Also a bipolar generator is known which contains a ventilator and a cleaning device that includes arms, each of the arms for cleaning a corresponding ionizing electrode of the ionizing electrodes from dust (refer to U.S. Pat. No. 5,768,087).

In this invention the ionizing electrodes are mounted on the stationary part of the ventilator, whereas the device for cleaning the electrodes from dust is mounted on the propeller.

The electrodes are shaped as needles, each of the electrodes is made from non-elastic wire, whereas the cleaning device constitutes a brush.

The centrifugal force in the device described in U.S. Pat. No. 5,768,087 $F_c=m\cdot\omega^2R$ (where $\omega$ is the angular velocity, R is the radius) the mass (m) is located at the end of cleaning device opposing the end contacting with the ionizing electrodes.

The cleaning device itself is limited by the dimensions of the propeller zone situated outside the airflow.

Hence, the radius is small and consequently the angular velocity is low.

At the same time when an electric motor of a certain size is used as a wind generator the rotation velocity of its propeller is always 2-3 times as low as that for the same motor used as an electric engine.

A three-fold decrease in the velocity for the same radius would require a nine times increase in the mass in order to yield the same centrifugal force.

This condition is unacceptable for the use of an electric motor as a power source because it renders an increase of the propeller weight and the value of the propeller starting rotation moment.

Also bipolar ion generation methods and ion generators are known wherein the air ionizing electrodes and mounted on the ventilator propeller (refer to WO 2004 008597A1 or JP 2004 362 855A). In the devices described in these publications no cleaning of the ionizing electrodes from dust is referred to.

One of the common drawbacks of all the known inventions consists in that the air ionizing electrodes are shaped either as sharp tip needles or as planar triangle structures (refer for example to Patent JP 2004 362855A).

During ionization metal emission occurs from the needle tips and in due course they become blunter which results in the decreased ion emission.

Another common drawback of all the mentioned inventions consists in the constant level of ions at the ion generator outputs.

This results in that the air flow velocity change, for example towards the velocity increase, causes the decrease of ion concentration in the premises.

On the one hand the decrease of ion concentration reduces the efficiency of the bacteria and viruses inactivation, whereas on the other hand the limit of the ion concentration level indoors is determined by a standard.

Hence the ion concentration in the premises should preferably be maintained constant and lower than the value set in the applicable standard at any changes of the air flow velocity.

DETAILED DESCRIPTION OF EMBODIMENTS

Figure 1:
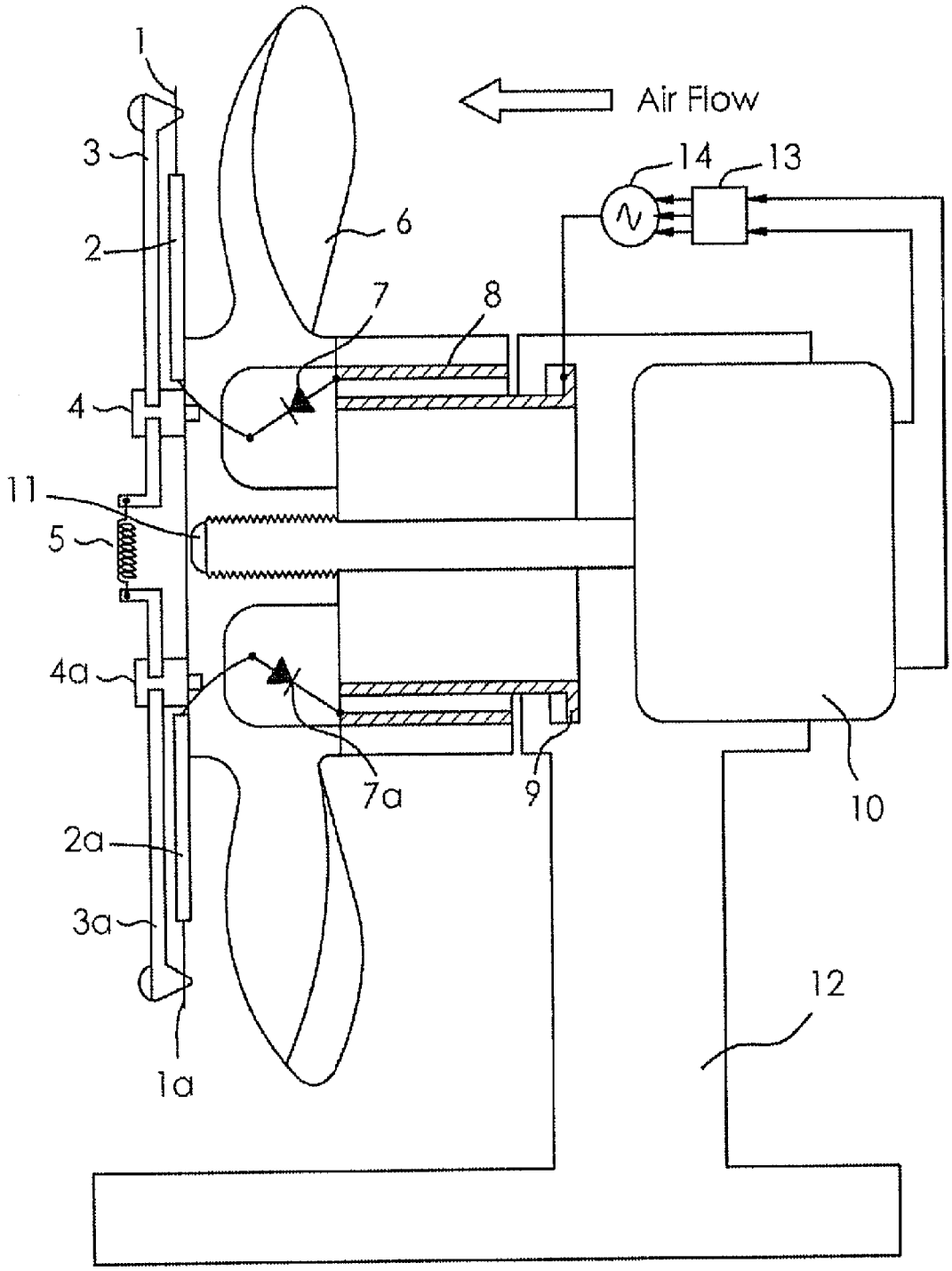
FIG. 1 shows the construction of the aerodynamic ion generator, according to embodiments of the present invention.

An object of the present invention is to eliminate the drawbacks of the existing bipolar ion generators and the methods of bipolar generation thereof.

The offered method of bipolar ion generation includes the following operations:

a. powering the AC high voltage generator from an electric motor with a propeller which is placed in the air flow;
b. high voltage supply to the air ionizing electrodes coupled to the propeller and
c. cleaning of the ionizing electrodes from dust using a cleaning device that includes arms, each of the arms for cleaning a corresponding ionizing electrode of the ionizing electrodes and pivotally attached to a shaft located on the propeller outside the air flow zone.

One of the above objects is achieved by that in the offered method of bipolar ion generation most of the mass of the arm is closer to a cleaning end of the arm than to the shaft that arm is attached to and it is coupled to the ionizing electrode during the propeller rotation.

The above technical solution enables at least three-fold increase in radius. This renders a three-fold increase in the angular velocity of the mass. The cumulative effect is generating a centrifugal force sufficient for operation of cleaning along with a 27-fold decrease of the cleaning device weight.

In order for the offered method to provide high quality cleaning of ionizing electrodes form dust they are made from elastic material, for example 0.06÷0.08 mm thin spring wire.

In such case the cleaning device can be made either rigid or elastic.

At the same time the use of thin ionizing electrodes gives a solution to the problem of metal emission from the electrode tips since the emission will only cause a slight change of the length of the ionizing electrodes.

Moreover, in the present invention for better cleaning the ionizing electrodes are separated from and the cleaning device when the propeller is still.

Coupling is created between them when the centrifugal force is increased during the increase of the propeller speed because of the change of the cleaning devices rotation angle relatively to the cleaning electrodes.

It is made to create coupling between them at a higher speed of approach for more efficient cleaning.

At further increase of the propeller speed they are uncoupled because of the increase of the centrifugal force.

As the air flow is stopped the propeller speed is reduced and the cleaning process is repeated in the reverse order.

The second object of the present invention, namely keeping the ion concentration in the premises constant at a change of the air flow velocity, is achieved through the use of the change of the air flow velocity itself.

Indeed, a change of the air flow velocity causes the change of the propeller speed which in turn results in the voltage change at the electric engine output.

This voltage is applied to the feeding terminals of the AC high voltage generator via the voltage-frequency converter.

The higher is the output voltage of the electrical motor the higher is the power impulses frequency of the AC high voltage generator and the higher is ion level at the ion generator output.

Taking into account that the voltage at the electric motor output is proportional to the air flow velocity the ion concentration in the premises remains constant in the entire range of the air flow velocity change.

Aerodynamic ion generator realizing the method is formed with an electrical motor having a propeller attached to its shaft, at least two air ionizing electrodes, at least two cleaning devices, at least two rotation shafts, at least one compensating spring, at least two rectification diodes, rotor and a stator of the air capacitor, voltage-frequency converter, AC high voltage generator and a base for mounting the electric motor.

FIG. 1 shows the construction of the aerodynamic ion generator, according to embodiments of the present invention.

The generator has ionizing electrodes 1 and 1*a*, electrode holders 2 and 2*a*, cleaning devices 3 and 3*a*, rotation shafts 4 and 4*a* of the cleaning devices, compensating spring 5, rectifying diodes 7 and 7*a* and rotor 8 of the air capacitor.

All the elements are mounted on propeller 6.

In addition the generator includes stator 9 of the air capacitor, electric motor 10 with shaft 11, base 12 for mounting the electric motor, voltage-frequency converter 13 and AC high voltage generator 14.

Propeller 6 is fastened on shaft 11 of electric motor 10, its output terminal being connected to the input terminals of voltage-frequency converter 13, and its output terminals being connected with power and control terminals of AC high voltage generator 14. High voltage output of generator 14 is connected to ionizing electrodes 1 and 1*a* via rectifying diodes 7 and 7*a* with different polarity connection.

Figure 2:
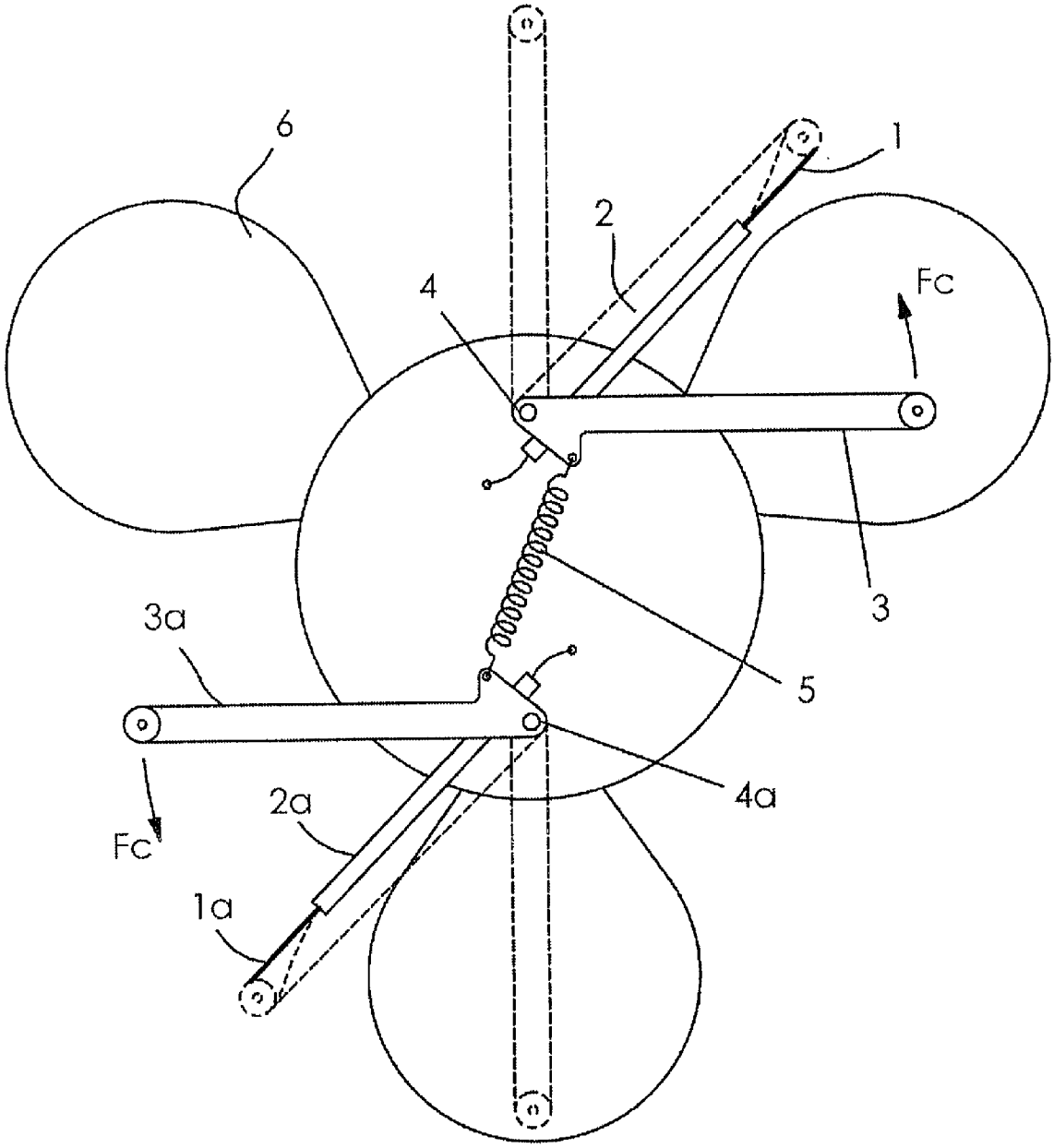
FIG. 2 illustrates a process of ionizing electrodes cleaning according to embodiments of the present invention.

FIG. 2 illustrates a process of ionizing electrodes cleaning according to embodiments of the present invention, as follows:

As can be seen from FIG. 1 one end of each of cleaning devices 3 and 3*a* is fastened to propeller 6 by means of shafts 4 and 4*a*.

Compensating spring 5 sets devices 3 and 3*a* into a state where in the absence of propeller 6 rotation there is no mechanic contact between their other ends and ionizing electrodes 1 and 1*a*.

With the increase of the speed of propeller 6, cleaning elements 3 and 3*a* begin turning on shafts 4 and 4*a* by action of centrifugal forces thus changing their angles relatively to ionizing electrodes 1 and 1*a*.

As devices 3 and 3*a* shift from their initial position a short mechanical contact is created with the ends of electrodes 1 and 1*a* to clean them from dust.

Figure 3:
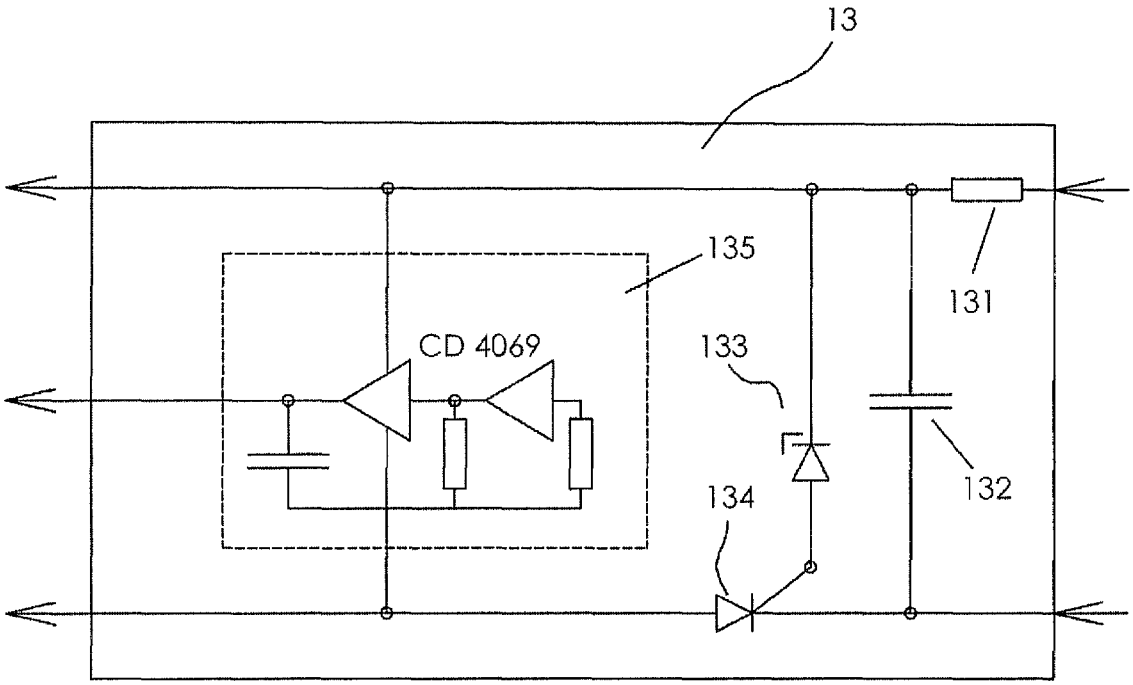
FIG. 3 is a schematic diagram of voltage-frequency converter 13, for incorporation in an aerodynamic ion generator, according to embodiments of the present invention.

FIG. 3 is a schematic diagram of voltage-frequency converter 13, for incorporation in an aerodynamic ion generator, according to embodiments of the present invention.

The circuit comprises resistor 131, condenser 132, Zener diode 133, thyristor 134 and oscillator 135.

The positive terminal of the electric motor via resistor 131 is connected to one of the condenser 132 terminals, with the cathode of Zener diode 133 and with the output terminal of converter 13 and positive power circuit of oscillator 135. The other terminal of condenser 132 is connected to the negative terminal of electric motor 10 and the cathode of thyristor 134, whose anode is connected with the negative power circuit of oscillator 135 and the other output terminal of converter 13.

At the same time the anode of Zener cathode 133 is connected with the control terminal of thyristor 134, and the output of oscillator 135 is connected to the output control terminal of converter 13.

Voltage-frequency converter 13 operation is as follows:

Voltage from electric motor 10 is applied to the charging circuit comprising resistor 131 and condenser 132. When the voltage across condenser 132 becomes equal to the breakdown voltage of Zener diode 133, Zener breakdown occurs and thyristor 134 is opened. The voltage drop across condenser 132 is simultaneously applied to oscillator 135 joined-up according to the classical scheme using two inverters series CD4069 and to AC high voltage generator 14.

Oscillator 135 forms a control impulse of a preset duration (e.g. 2 ms) at its output which is applied to the control input of the AC high voltage generator 14.

Generator 14 generates high voltage during this time period. Since generator 14 constitutes a load for condenser 132, the voltage drop applied across this condenser is lower than the breakdown voltage of Zener diode 133.

Consequently at the end of oscillator 135 impulse thyristor 134 is closed.

In the absence of load the voltage across condenser 132 is increased to the breakdown voltage of Zener diode 133 and the cycle is repeated.

The frequency of the impulses in this scheme is proportional to the voltage generated by the electric motor.

An aerodynamic ion generator according to embodiments of the present invention was successfully constructed and tested by the inventor of the present invention. Several parameters of the device are listed below.

| | | |
|---|---|---|
| 1 | Ventilator dimensions | 120 × 120 × 25 mm |
| 2 | Number of ionizing electrodes | 2 |
| 3 | Diameter of the ionizing electrodes | 0.08 mm |
| 4 | Weight of the cleaning device | 1 g |
| 5 | Minimal velocity of the air flow | 3 m/sec |
| 6 | Frequency of the AC high voltage generator | 100 kHz |

-continued

| | | |
|---|---|---|
| 7 | Amplitude of the AC voltage | ±6 kV |
| 8 | Control pulse duration | 2 ms |
| 9 | Ion output | $10^{10}$ ion/sec |
| 10 | Ozone level | 1 ppb |

I claim:

1. An aerodynamic ion generator comprising:

an electric motor coupled to a propeller for placing in an airflow to generate electrical energy, with ionizing electrodes coupled to the propeller;

an AC high voltage generator powered by the electric motor for generating AC high-voltage;

an electrical transmission arrangement for transmitting the AC high voltage to the ionizing electrodes of different polarities; and a cleaning device that includes arms, for cleaning a corresponding ionizing electrode of the ionizing electrodes, each of the arms pivotally attached to a shaft located on the propeller wherein most of the mass of the arm is closer to a cleaning end of the arm than to the shaft that arm is attached to.

2. A generator as claimed in claim 1, wherein an angle is defined between each of the arms and the corresponding electrode when the propeller is not rotating.

3. A generator as claimed in claim 2, wherein the angle is maintained by an elastic element connected between the arms.

4. A generator as claimed in claim 3, wherein the elastic element is a spring.

5. A generator as claimed in claim 1, wherein each of the ionizing electrodes is made from an elastic wire.

6. A generator as claimed in claim 1, comprising a voltage-frequency converter to provide constant ion concentration, inputs of the converter being connected to the electric motor and outputs of the converter being connected to low potential inputs of the AC high voltage generator.

7. A method for ion generation comprising:

placing an ion generator that includes an electric motor coupled to a propeller, with ionizing electrodes coupled to the propeller, in an airflow;

generating AC high-voltage using an AC high voltage generator;

transmitting the AC high voltage to the ionizing electrodes maintaining different polarities; and cleaning the ionizing electrodes using a cleaning device that includes arms, each of the arms for cleaning a corresponding ionizing electrode of the ionizing electrodes and pivotally attached to a shaft located on the propeller wherein most of the mass of the arm is closer to a cleaning end of the arm than to the shaft that arm is attached to.

8. A method as claimed in claim 7, wherein an angle is defined between each of the arms and the corresponding electrode when the propeller is not rotating.

9. A method as claimed in claim 8, wherein the angle is maintained by an elastic element connected between the arms.

10. A method as claimed in claim 9, wherein the elastic element is a spring.

11. A method as claimed in claim 7, wherein each of the ionizing electrodes is made from an elastic wire.

12. A method of bipolar ion generation comprising:

using an ion generator that includes an electric motor coupled to a propeller for powering the ion generator, to generate bipolar ions in an airflow;

controlling output of the bipolar ions to be proportional to the speed of the air-flow; and using a voltage-frequency converter to control the output of the bipolar ions, inputs of the converter being connected to the electric motor and outputs of the converter being connected to low potential inputs of an AC high voltage generator.

* * * * *

UNITED STATES PATENT AND TRADEMARK OFFICE

CERTIFICATE OF CORRECTION

PATENT NO. : 7,969,707 B2
APPLICATION NO. : 12/687498
DATED : June 28, 2011
INVENTOR(S) : Yefim Riskin It is certified that error appears in the above-identified patent and that said Letters Patent is hereby corrected as shown below:

In the front page, after item (76) insert the following:
-- Assignee: FILT AIR LTD., Zikhron Yaaqov (IL) --

Signed and Sealed this
Twenty-eighth Day of February, 2012

David J. Kappos

David J. Kappos
*Director of the United States Patent and Trademark Office*